US005093995A

United States Patent [19]

Jan

[11] Patent Number: 5,093,995

[45] Date of Patent: Mar. 10, 1992

[54] KNIFE LOCK MECHANISM

[76] Inventor: James Jan, 10 Homestead Rd., Elmwood Park, N.J. 07407

[21] Appl. No.: 610,014

[22] Filed: Nov. 7, 1990

[51] Int. Cl.[5] ..... B26B 1/04; B26B 1/00; B26B 1/02; B26B 3/06

[52] U.S. Cl. ..... 30/161; 30/160; 30/159; 30/155

[58] Field of Search ..... 30/155-162, 30/164.5, 157, 159, 160, 161

[56] References Cited

U.S. PATENT DOCUMENTS

| | | | |
|---|---|---|---|
| 3,942,249 | 3/1976 | Poehlmann | 30/161 |
| 4,170,061 | 10/1979 | Henry | 30/160 |
| 4,478,532 | 10/1984 | Puro | 30/155 |
| 4,535,539 | 8/1985 | Friedman et al. | 30/159 |
| 4,670,984 | 6/1987 | Rickard . | |
| 4,918,820 | 4/1990 | Korb et al. | 30/155 |
| 4,947,552 | 8/1990 | Barnes | 30/159 |

FOREIGN PATENT DOCUMENTS

| | | | |
|---|---|---|---|
| 60608 | 2/1891 | Fed. Rep. of Germany | 30/160 |

*Primary Examiner*—Douglas D. Watts
*Assistant Examiner*—Paul M. Heyrana, Sr.

[57] ABSTRACT

A folding knife having a blade that can be pivoted into or out of a hollow knife handle. A depressible lock pin extends parallel to the blade pivot axis to normally extend through a notch in an arcuate edge of the blade, thereby holding the blade in a designated position (open or closed). Depression of the lock pin enables a transverse slot in the pin to register with the blade, such that the blade can be swung to a desired position.

4 Claims, 1 Drawing Sheet

KNIFE LOCK MECHANISM

BACKGROUND AND SUMMARY

This invention relates to a folding knife having a manually depressible lock element for holding the knife blade in a closed position or an open position. The lock element is preferably formed as a slidable lock pin movable at right angles to the motion plane of the blade, such that the blade cannot easily deflect the lock pin from its lock position.

U.S. Pat. No. 4,670,984 issued to T. Richard shows a folding knife that is in some respects similar to the knife of the present invention. However in the knife of U.S. Pat. No. 4,670,984 the lock element is formed as a lateral extension of the blade pivot pin. This extension would in many cases have to be a relatively small size structural component. I believe such a small size component might have strength deficiencies and alignment deficiencies. Also, assembly (manufacture) of the pivot pin-lock element combination might prove to be a relatively difficult manipulative operation. The lock element mechanism of my invention is believed to have advantages over the lock element shown in U.S. Pat. No. 4,670,984.

THE DRAWINGS

DESCRIPTION OF A PREFERRED EMBODIMENT OF THE INVENTION

Figure 1:
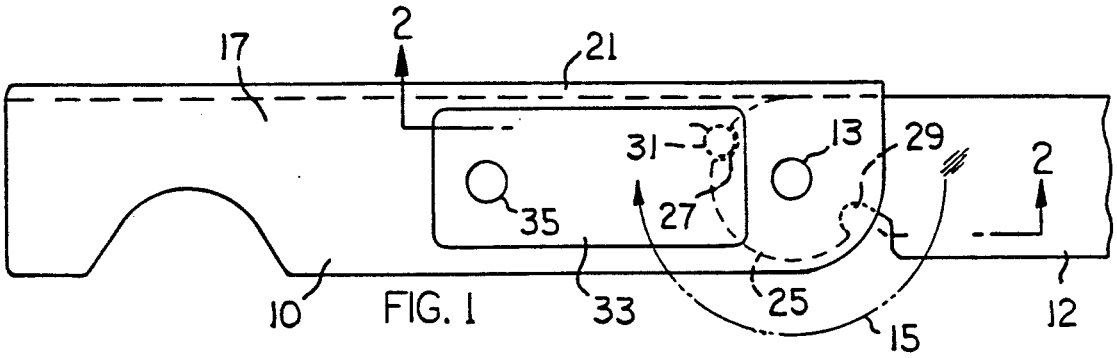
FIG. 1 is a fragmentary side elevational view of a folding knife embodying this invention. The knife blade is shown in an open position.
Figure 2:
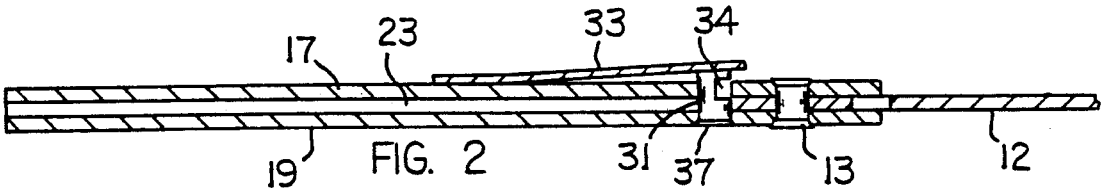
FIG. 2 is a sectional view taken on broken line 2—2 in FIG. 1.
Figure 3:
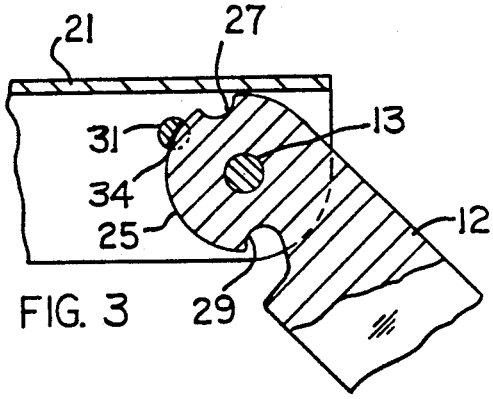
FIG. 3 is a fragmentary sectional view of the FIG. 1 knife in the general plane of the knife blade.

FIGS. 1 through 3 illustrate a folding knife that includes a hollow handle 10 and a flat blade 12. The blade is adapted for swinging motion around a pivot pin 13 for movement between an open position (shown in FIG. 1) and a closed position telescoped into the handle. Numeral 15 in FIG. 1 designates the arcuate swinging motion of the blade between its open and closed positions.

Handle 12 comprises two flat parallel walls 17 and 19 connected along adjacent edge areas by means of a web wall 21. The two walls 17 and 19 are spaced apart to form a blade-accommodation space 23. A pivot pin 13 extends between walls 17 and 19 near one end of the blade-accommodation space.

The knife blade has a circular hole concentric with pivot pin 13, such that the blade can be manually swung around the pivot pin axis. An arcuate edge 25 is formed on the blade concentric with the pivot pin axis. Two diametrically-spaced notches 27 and 29 are formed in the arcuate blade edge to mate with a circular lock pin 31. As seen in FIGS. 1 and 3, each notch has a semi-circular configuration conforming to the side surface contour on lock pin 31.

Lock pin 31 extends freely through circular holes in handle walls 17 and 19, such that the pin can be manually depressed for slidable motion parallel to the axis of pivot pin 13. Extending transversely through lock pin 31 is a semi-circular slot 34. A leaf spring 33 has one end thereof attached to pin 31 near its rightmost edge (FIGS. 1 and 2). Near its leftmost edge the leaf spring is attached to wall 17 by a rivet 35. The spring is configured to normally bias lock pin 31 upwardly (in FIG. 2) to a position wherein the cylindrical pin extends through one of the notches in blade edge 25. A flange 37 on the pin limits the pin motion in the upward direction.

Slot 34 is located along the side surface of the lock pin so that when downward manual pressure is applied to the right most portion of spring 33 the slot moves into the plane of blade 12. The slot is slightly wider than the blade thickness, such that when lock pin 31 is depressed edge 25 of the blade can move through slot 34; the blade can be swung around pin 13 to the open or closed position. In the position shown in FIGS. 1 and 2 notch 27 retains the blade locked in the open position. When the blade is swung clockwise (arrow 15 in FIG. 1) and pressure on spring 33 is released, notch 29 can engage pin 31 for holding the blade in the closed position. FIG. 3 shows the blade in an intermediate position, with the arcuate edge 25 of the blade extending through slot 34 in lock pin 31. When the blade reaches its closed or open position the leaf spring snaps the lock pin to its locked position extending through one of the notches in blade edge 25. There is an audible clicking that alerts the person to the fact that the blade is locked. The lock pin extends across the blade edge to provide a relatively high strength lock action resistant to deflection or excessive wear.

Figure 4:
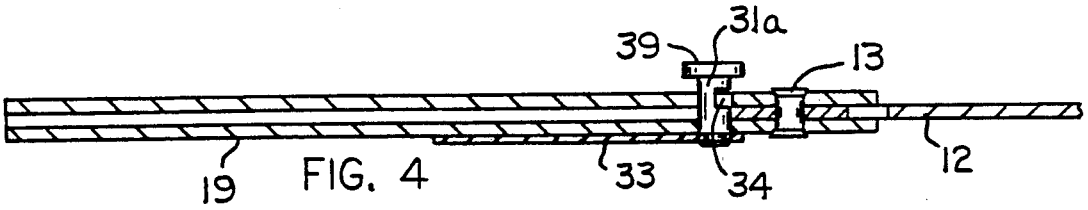
FIG. 4 is a view taken in the same direction as FIG. 2, but illustrating another form of the invention.

FIG. 4 shows a second form of the invention, wherein leaf spring 33 has a portion thereof connected to wall 19 and another portion thereof connected to the lower end of lock pin **31*a*. The lock pin has an enlarged head 39 on its upper end. Spring 33** is configured to exert an upward pushing action on the pin.

Manual pressure on head 39 depresses the lock pin so that its transverse slot 34 lies in the plane of the knife blade 12, thereby permitting the blade to be manually swung around the axis of pivot pin 13. Normally spring 33 will hold lock pin **31*a*** in its lock position extending through one of the notches in the arcuate edge of the blade.

The drawings show two specific forms of the invention. However, it will be appreciated that the invention can be practiced in other forms.

I claim:

1. A folding knife comprising a handle having two spaced parallel walls forming a blade-accommodation space; a pivot pin (13) extending transversely between said spaced walls to form a pivot axis; a cutting blade mounted on said pin for swinging motion around said pivot axis into or out of the blade-accommodation space; said blade having an arcuate peripheral edge (25) centered on the pivot pin axis, at least one notch formed in said arcuate blade edge; a manually depressible lock pin slidably mounted in said handle for slidable linear motion parallel to the pivot pin axis; said lock pin having a cross-section mated to the notch in the blade edge, said lock pin having a normal position extending through said notch to lock the blade in a fixed position relative to the handle; spring means normally biasing said lock pin to its blade-locking position; said lock pin having a transverse slot (34) in a side surface thereof adapted to register with the arcuate edge of the knife blade when the lock pin is manually depressed, whereby the blade can then be pivoted around the pivot pin axis.

2. The knife of claim 1, wherein said spring means is a leaf spring having a portion thereof connected to said handle and another portion thereof connected to said lock element.

3. The knife of claim 1, wherein said lock pin is a circular lock pin; said transverse slot being a semi-circular slot formed in the circular side surface of the lock pin; said notch being a semi-circular notch conforming to the side surface contour on the circular lock pin.

4. The knife of claim 1, wherein there are two notches formed in the arcuate blade edge; said notches being located on a diametrical line passing through the pivot pin axis; said notches being located so that when the lock pin extends through one of the notches the blade is in its open position, and when the lock element extends through the other notch the blade is in its closed position.

* * * * *